United States Patent [19]

Mureso

[11] 4,033,148

[45] July 5, 1977

[54] NEEDLE SELECTING DEVICE

[75] Inventor: Vladimir Mureso, Brno, Czechoslovakia

[73] Assignee: Vyzkumny a vyvojovy ustav Zavodu vseobecneho strojirenstvi of Czechoslovakia, Brno, Czechoslovakia

[22] Filed: Aug. 8, 1975

[21] Appl. No.: 603,016

[52] U.S. Cl. ..... 66/50 R

[51] Int. Cl.[2] ..... D04B 15/78

[58] Field of Search ..... 66/50 R, 75 A, 38

[56] References Cited

UNITED STATES PATENTS

| | | | |
|---|---|---|---|
| 3,641,787 | 2/1972 | Robottom | 66/50 R |
| 3,690,125 | 9/1972 | Tenconi | 66/50 R X |
| 3,710,594 | 1/1973 | Bourgeois | 66/50 R |
| 3,744,275 | 7/1973 | Harris | 66/50 R X |
| 3,835,668 | 9/1974 | Schiebel et al. | 66/50 R X |
| 3,835,669 | 9/1974 | Findlay et al. | 66/50 R |
| 3,851,500 | 12/1974 | Wolfshagen | 66/50 R |

FOREIGN PATENTS OR APPLICATIONS

| | | | |
|---|---|---|---|
| 1,470,573 | 1/1967 | France | 66/50 R |
| 1,376,339 | 9/1964 | France | 66/50 R |
| 1,594,994 | 7/1970 | France | 66/50 R |
| 2,039,610 | 3/1971 | Germany | 66/50 R |
| 351,046 | 6/1931 | United Kingdom | 66/50 R |

*Primary Examiner*—Louis K. Rimrodt
*Assistant Examiner*—A. M. Falik

[57] ABSTRACT

Selecting device for the individual selection of the operating means in knitting machines, particularly in large diameter circular knitting machines with rotating needle beds and an electronic selection mechanism. Said device includes at least one selecting magnet which is fixed with respect to the cam system, and selectors slidable in grooves of a needle bed, said selectors having at least an elastic central part, the lower part of the selector being located within the active range of the selecting magnet, the upper end surface of the selector being inclined towards the cylinder cam box. A slider is swingably arranged about a joint in its upper part inside a groove of the needle bed above each selector, the lower part of said slider being provided with a recess selectively receiving the upper part of the selector.

5 Claims, 5 Drawing Figures

NEEDLE SELECTING DEVICE

The present invention relates to a selecting device for the individual selection of operating means in knitting machines, particularly in large diameter circular knitting machines with rotary needle beds and electronic needle selecting means.

Devices are known, in which the selection of the separate operating means, particularly knitting needles, is performed by applying electric principles, the selecting mechanism having a permanent magnet combined with an electromagnet.

In those hitherto known devices, the selecting magnet acts upon a resiliently mounted part which moves in accordance with the needle bed.

The said resiliently mounted part may occupy either of two positions at the selection point depending upon whether or not a pulse was emitted into the selecting magnet. One of these positions causes the required movement of the appurtenant knitting needle into its tuck or clearing position, while the other position of the resiliently mounted part is intended to leave the knitting needle in its passing-through position. The motion of the knitting needle is usually initiated by sinkers, jacks or other parts forming the control system of one needle in cooperation with the cams by which the needles are acted upon due to the force of a spring or a selecting magnet.

The disadvantage of those devices known previously consist in their excessive intricacy, which prolongs the time required for pulse transmission from the programming device to the knitting needle.

The present invention has among its objects the mitigation of the above disadvantages and provides a simple and reliable operating device with the fastest possible time of pulse transmission to the knitting needle, and with large patterning possibilities.

This invention is an improvement upon that disclosed in my prior application Ser. No. 467,120, filed May 6, 1974 which matured into U.S. Pat. No. 3,972,206 on Aug. 3, 1976.

In accordance with a preferred embodiment of the present invention, there is provided at least one selecting magnet which is fixed with respect to the cam system, and selectors mounted in the grooves of the needle bed, said selectors each having at least a resilient central part and a bottom part located within the radius of action of the selecting magnet, the upper edge of said selector being inclined towards the cylinder cam box and a slider swingably mounted about a joint in its upper part above each selector inside the groove of the needle bed. The bottom part of said slider is provided with a recess selectively to receive the upper part of the selector.

Further, below the selectors there are fixedly mounted with respect to the cam system, a deflecting cam and at least one selector raising cam, there being a recess in the upper part of the slider for the purpose of guiding the lower part of the knitting needle. The slider is provided with a first butt for cooperation with a pushing cam and with a second, further butt for cooperation with a tuck raising cam, a clearing raising cam, and a sinker cam.

Among the advantages of the present invention are the simplicity of the manner of pulse transmission from the programming device to the knitting needle while preserving large patterning possibilities, and the possibility of lifting the knitting needles in each feed into various positions.

A preferred embodiment in the form of an example of the present invention is shown in the accompanying drawings, in which.

Figure 1:
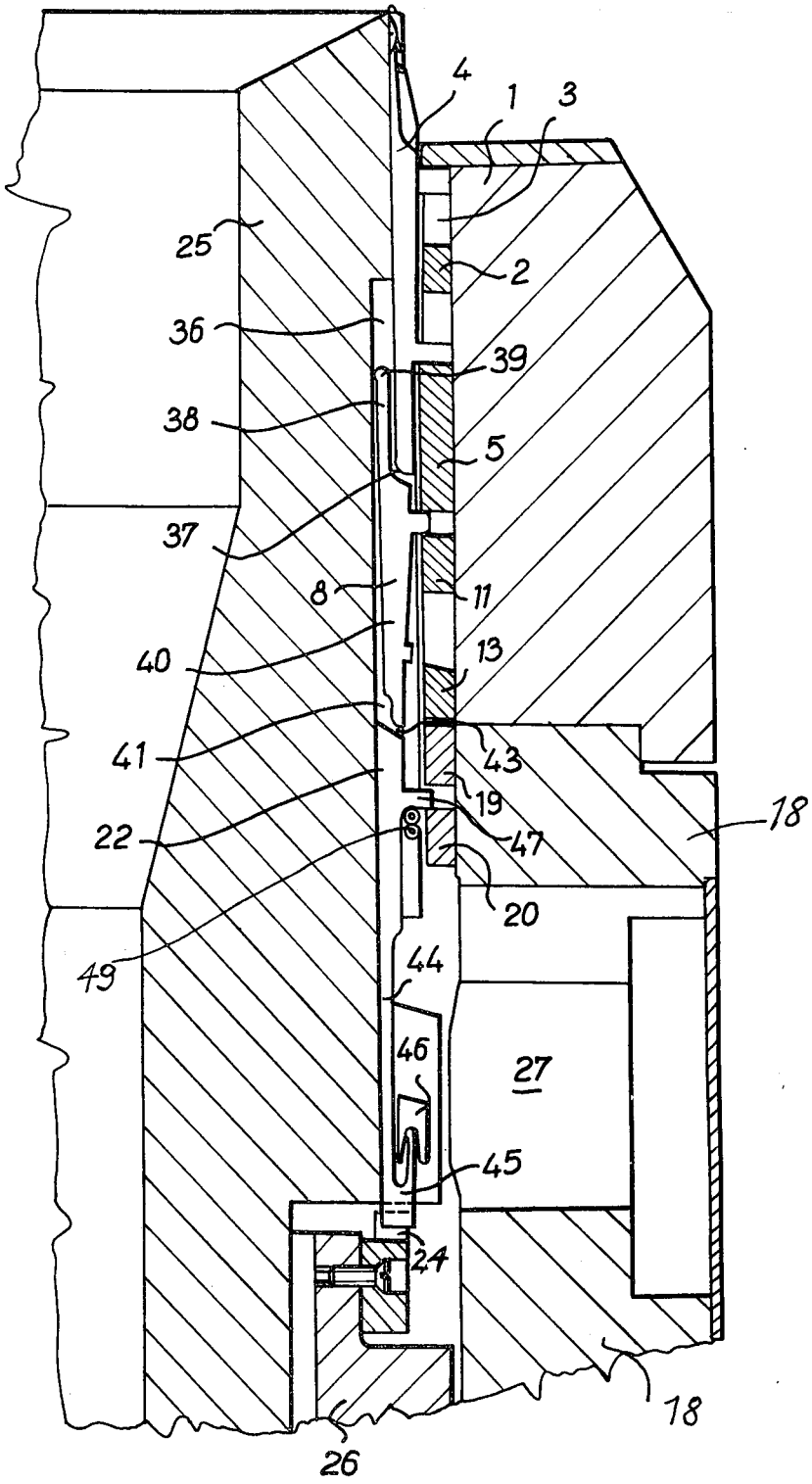
FIG. 1 is a view in vertical axial section through the cylindrical needle bed and the cam system of a circular knitting machine, the movable operative parts being shown in their basic positions.

On a fixed circular knitting machine frame, only a fragment of which is shown at 26, there is mounted a cylinder cam box 1 together with the cam system. In the upper part of this cam system (FIG. 2) there is mounted a sinker or stitch cam 2 and a guiding cam 3 for the direct control of knitting needles 4, which are slidably mounted in grooves or tricks 36 on the outer surface of a rotatable needle cylinder 25. Below cam 2 there are a sinker cam 5 and a pushing cam 6 for cooperation with upper butts 7 of sliders 8 which are also slidably mounted in grooves 36.

Figure 2:
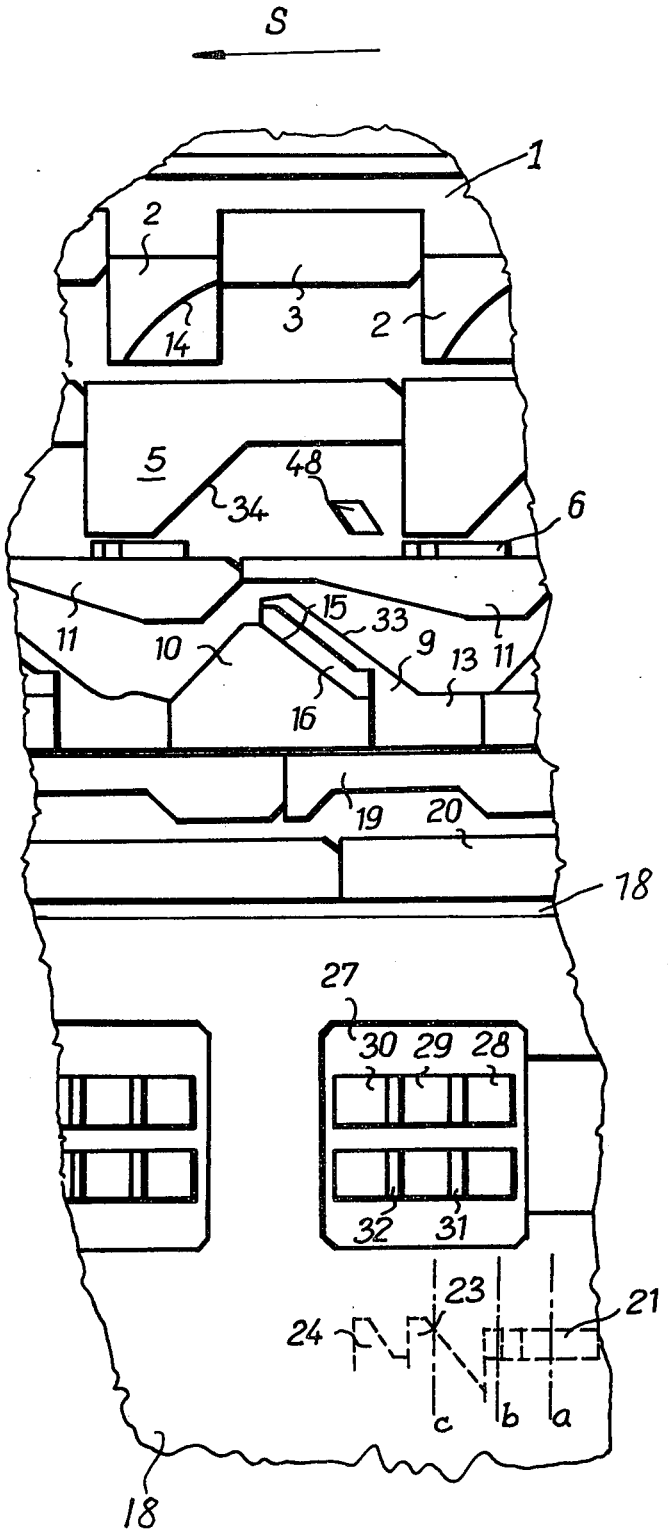
FIG. 2 is a view in elevation of a cam system of one feed including the selecting means.

A further row of the cam system comprises a clearing raising cam 9, a tuck raising cam 10, and a sinker cam 11 for cooperation with lower butts 12 of sliders 8. The beginning of the clearing raising cam is formed by a guiding part 13 which is disposed at a location which is circumferentially at the same location as the pushing cam 6. The circumferential location of the beginning of said guiding part 13 corresponds to the circumferential location of the end part of operative edge 14 of sinker cam 2 for knitting needles 4. Between the active surface 15 of the tuck raising cam 10 and the clearing raising cam 9 there is a groove 16 which is open at only one side, at the top of tuck raising cam 10 in the direction S (FIG. 2).

In a further, intermediate row of the cam system there are mounted a selector sinker cam 19 and a guiding cam 20. The cam system of the knitting machine also comprises a lowermost row mounted on a fixed machine part 18, a deflecting cam 21 for selectors 22, and raising cams 23 and 24 for selectors 22. In contrast to the cams in the upper and intermediate rows, said cams 21, 23 and 24 are not mounted on the cylinder cam box 1, but instead are mounted below the rotatable cylindrical needle bed 25 on the fixed carrier 26 for the needle bed 25 or on another stationary part of the machine.

Below the cam level in the cylinder cam box 1 and above cams 21, 23 and 24, there is mounted at least one composite selecting magnet 27. In the embodiment of the present invention illustrated in the drawings, each feed is provided with one selecting magnet 27. This means that it is possible to make patterns in each feed. The composite selecting magnet 27 consists of five parts, of which three are permanent covering magnets 28, 29, 30 and two are selecting magnets 31, 32. These selecting magnets 31, 32 consist of permanent magnets provided with an electrical winding (not shown) which forms an electromagnet having a polarity, when energized, which is opposite that of the permanent magnet. The first selecting magnet 31 selects those knitting needles 4 which should be lifted to their clearing position, while the second selecting magnet 32 is intended for selecting those knitting needles 4 which should be lifted to their tucking position.

In the direction of the circumference, selecting magnet 27 covers the guiding part 13 of the clearing raising cam 9 and overlaps the end parts of active lifting surfaces 33, 15 of both the clearing raising cam 9 and the tuck raising cam 10. The first selecting magnet 31 is situated, relative to the circumference, approximately in the middle of the guiding part 13 of the clearing raising cam 9 and the second selecting magnet 32 is situated, relative to the circumference, immediately in front of the beginning of groove 16 between the active lifting surface 15 of tuck raising cam 10 and clearing raising cam 9. Both selecting magnets 31, 32 are mounted at the circumference behind the active edge 34 of sinker cam 5 for sliders 8 and also behind the active surface 14 of sinker cam 2 for knitting needles 4.

The deflecting cam 21 is mounted at the circumference with its top at the beginning of selecting magnet 27, and raising cams 23 and 24 are always mounted behind the selecting magnets 31 and 32 at the circumference, the position of said cams 21, 23 and 24 being represented in dash lines in FIG. 2. At the point of raising cam 24 there is mounted a support 48 for preventing slider 8 from being lifted upon lifting selector 22, this being performed by acting upon the upper butt 7 of the said slider 8.

The selecting magnet 27 and all its parts, particularly selecting magnets 31, 32, may be, however, of various other constructions. Only the above-mentioned arrangement on the circular knitting machine is of importance.

A cylindrical needle bed 25 is rotatably mounted concentrically with cylinder cam box 1 on the circular knitting machine, said needle bed being closely attached to the cylinder cam box 1 as is conventional in known knitting machines.

Figure 3:
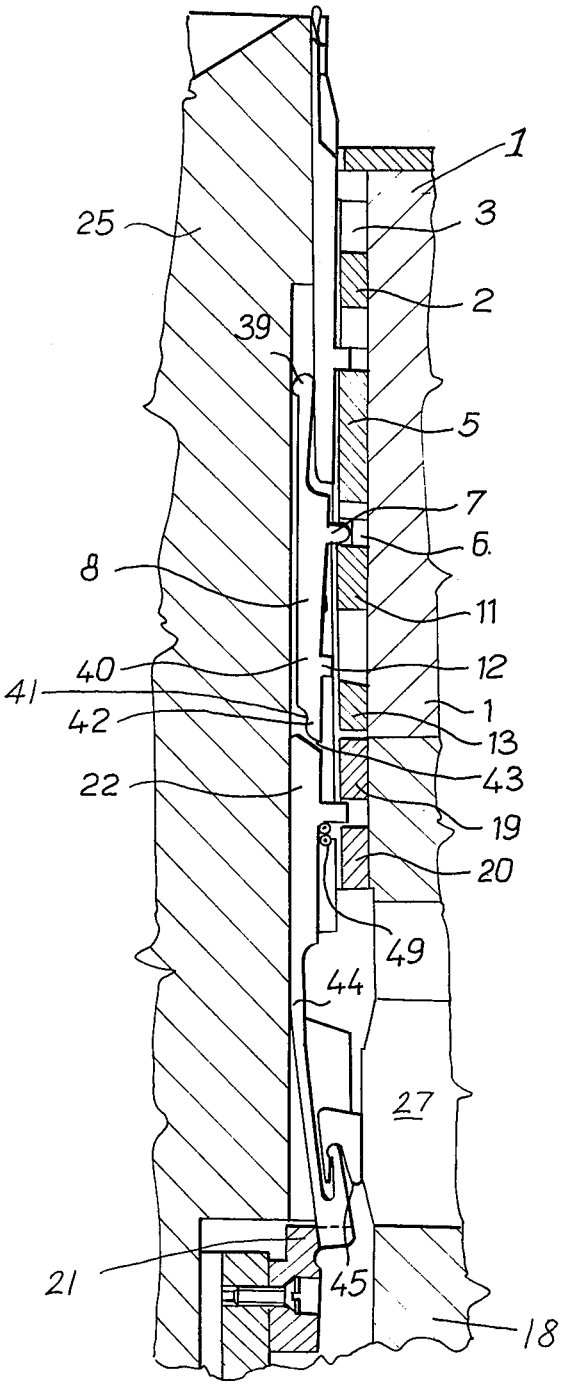
FIG. 3 is a view in section through a cylindrical needle bed and a cam system similar to FIG. 1, the section being taken along the line *b* of the machine circumference as shown in FIG. 2.
Figure 4:
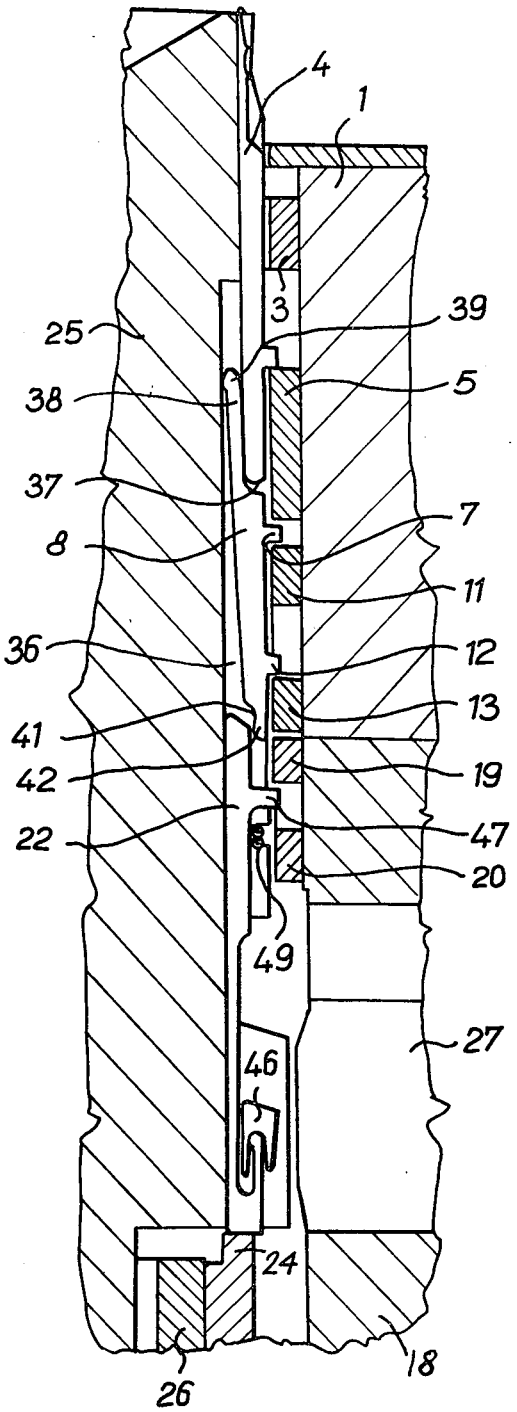
FIG. 4 is a view in section through a cylindrical needle bed and a cam system similar to FIG. 1, the section being taken along the line *c* of the machine circumference as shown in FIG. 2.
Figure 5:
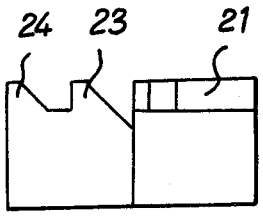
FIG. 5 is a fragmentary view in elevation of the control cams for the selector.

In cylindrical needle bed 25 there are grooves 36 for mounting movable operative parts, shown here as knitting needles 4, slider 8 and selectors 22 (FIGS. 1, 3 and 4). Grooves 36 are shallower at the location of the upper part of knitting needle 4 than in their remaining part.

Each knitting needle 4 is provided with butt 37 for cooperation with cams 2, 3. In its lower part, the knitting needle 4 does not abut against the bottom of groove 36, but abuts against slider 8 in which a recess 37 is provided for the purpose of guiding the said bottom part of knitting needle 4. On the upper part 38 of slider 8 there is a joint 39 which abuts, on the one hand, against the bottom of groove 36, and, on the other hand, against the lower part of knitting needle 4. Thus, the whole slider 8 is swingable about this joint 39. On the lower part 40 of slider 8, there is a recess 41 for pushing selector 22 on the side of the bottom of groove 36 in needle bed 25, and thus the foot 42 of slider 8 is narrowed. The slider 8 is provided with two butts 7, 12 for cooperation with cams 5, 6, 9, 10 and 11.

Below slider 8 a selector 22 is arranged in the groove, the upper end surface 43 of said selector being skewed downward in the direction towards the cylinder cam box 1. Selector 22 is slidably mounted in groove 36, i.e., with only one degree of freedom, but its central part 44 is made resilient. According to the illustrative embodiment of the invention, selector 22 is made of elastic material, such as spring steel, and its central part 44 is weakened, thus permitting a resilient bending of this part 44. At its lower part 45, selector 22 is provided with an auxiliary sinker 46 for engagement with the extensions of selecting magnet 27. Selector 22 is provided with butt 47 for cooperation with cams 19 and 20. At the bottom of grooves 36 the upper parts of selectors 22 are held by springs 49.

For the purpose of prolonging the time reserves upon transmitting the pulses from the programming device to the winding of selecting magnets 31, 32, it is possible to make the selectors 22 of two different lengths and to arrange them alternatingly on the knitting machine. The selecting magnet 27 in the illustrative embodiment has divided extensions, as shown in FIG. 2, and each selecting magnet 31, 32 is provided with two windings, into which pulses are transmitted separately.

The device according to the present invention operates as follows:

The cylindrical needle bed 25 rotates in the direction S (FIG. 2) upon operation of the machine while cylinder cam box 1 including all cams thereon is stationary. When auxiliary sinker 46 is brought at the point of arrangement of deflecting cam 21, said cam deflects the lower part 45 of selector 22 to such extent that auxiliary sinker 46 which is connected to selector 22 by means of a joint comes into contact with the first covering permanent magnet 28 of selecting magnet 27 (FIG. 3). The upper part of said selector 22 remains in its original position by the action of springs 49. By the action of permanent magnet 38, auxiliary sinker 46, and together therewith also the lower part 45 of selector 22, are held in contact with selecting magnet 27 even after stopping the action of the deflecting cam 21. Upon further rotation of the needle cylinder, auxiliary sinker 46 comes into contact with the first selecting magnet 31. When a pulse is transmitted into said selecting magnet 31 from a programming device of known construction (not shown), the action of said selecting magnet 31 is weakened, and this due to the elasticity of the central part 44 of selector 22, the lower part 45 of said selector 22 moves towards the bottom of groove 36 into the position shown in FIG. 1. Upon further rotation of needle bed 25, the lower part 45 of selector 22 comes into contact with raising cam 23 which causes its relatively short lifting. Thereupon, by the mutual action of the included upper part 43 of selector and foot 42 of slider 8, said slider is swung about joint 39 in the direction towards cylinder cam box 1, the lower butt 12 of slider 8 thus coming into the range of activity of clearing raising cam 9.

Together with slider 8, the appurtenant knitting needle 4 is also lifted into clearing position, a normal stitch being knitted on said needle 4 after feeding yarn. The slider 8 is brought back into its initial position by sinker cam 5 and knitting needle 4 by sinker cam 2. After bringing slider 8 back into its initial, basic position (FIG. 1), slider 8 is pushed back to the bottom of groove 36 by cooperation of pushing cam 6 and upper butt 7. Thereupon, slider 8 is prepared for a further possible selection in the following feed. Selector 22 is drawn back into its basic position by sinker cam 19 during the lifting of slider 8 with knitting needle 4, this making it possible to start selection, i.e., the deflection of the lower part 45 of selector 22 towards selecting magnet 27 before pulling slider 8 and knitting needle 4 down completely.

If at the moment of contact of auxiliary sinker 46 with the first selecting magnet 31 a pulse is not transmitted to said magnet, the auxiliary sinker 46 is further held, together with bottom part 45 of selector 22, in contact with selecting magnet 27. As a consequence, selector 22 bypasses raising cam 23, remains in its basic position and slider 8 is left in the position adjacent to the bottom of the groove, i.e., slider 8 and knitting needle 4 thus remain in their basic position.

Upon further procedure, auxiliary sinker 46 comes into contact with second selecting magnet 32. If no pulse is fed into the winding of this magnet, then auxiliary sinker 46 remains in contact with selecting magnet 27. Slider 8 and knitting needle 4 remain in their basic position and needle 4 does not knit at all in that feed.

If, however, a pulse is fed into selecting magnet 32, the action of magnet 32 is weakened and lower part 45 of selector 22 moves away from selecting magnet 27. Thus, said part comes, upon further rotation of the needle cylinder, into engagement with the second raising cam 24 for selectors 22. Upon lifting selector 22 by raising cam 24, slider 8 is swung out by mutual action of the upper edge 43 of selector 22 and foot 42 of slider 8, the lower butt 12 of sider 8 thus projecting into groove 16 between the active surface 15 of tuck raising cam 10 and clearing raising cam 9. Upon further rotation of the needle cylinder, slider 8 is lifted by tuck raising cam 10 into the tucking position and, together with slider 8, knitting needle 4 is also lifted to its tucking position. Then the knitting needle 4, slider 8 and selector 22 are lowered to their basic position by the same means as upon their being lifted into clearing position, i.e., by sinker cams 2, 5 and 19, whereupon a tuck loop is formed on the knitting needle 4 and selector 22, slider 8 and knitting needle 4 being prepared for selection in the further feed.

As the present invention makes possible a needle selection to the clearing as well as to the tucking position in each feed, it is particularly suitable for being used with large diameter knitting machines. The present invention can be applied not only to a cylinder bed, but also to a dial bed.

In spite of the fact that the present invention is particularly intended for being used with circular knitting machines with rotating beds, it is also possible to apply it in circular knitting machines with circulating cam systems, since the mutual relative motion of needle beds and cam systems remains the same in both cases.

Furthermore, it is possible to use the present invention in small diameter circular knitting machines, as well as in flat bed knitting machines with unidirectional movement of the knitting feeds.

Although the invention is illustrated and described with reference to a single preferred embodiment thereof, it is to be expressly understood that it is in no way limited to the disclosure of such a single preferred embodiment, but is capable of numerous modifications within the scope of the appended claims.

What is claimed is:

1. In a knitting machine having a support, a needle bed, the needle bed and support being mounted for relative rotation, a plurality of grooves disposed in spaced relation in the needle bed to form needle tricks, a needle slidably mounted in the upper portion of each groove, an elongated slider movably mounted in each groove below the needle and having a recessed upper end adapted for overlying cooperation with the lower end of the needle, an elongated selector slidably mounted in the groove below the portion of the slider, the improvement which comprises a needle selecting device wherein an energizable selecting magnet means and a permanant magnet means are fixedly associated with the support for engagement with means on one side of the lower portion of the selector, and cam means fixedly associated with the support and cooperable with the bottom surface of the lower portion of the selector for actuating the selector to engage the lower end of the slider when the selecting magnet means is energized, wherein the upper portion of the selector is restrained from radial movement in the groove; wherein the central portion of the selector is made resilient whereby the other side of the lower end of the selector may be acted upon by said cam means, not withstanding the radial movement towards the permanent magnet means; wherein the upper end of the slider is confined between the bottom of the associated groove and the bottom portion of the overlying needle to define a fulcrum on the upper portion of the slider; and wherein the upper portion of the selector and the lower portion of the slider have cooperating camming surfaces whereby an upward movement of the selector along the groove causes a pivot of the lower portion of the slider about said fulcrum.

2. A knitting machine as claimed in claim 1, wherein the cam means comprises a deflecting cam and at least one raising cam for the selectors disposed beyond the selecting magnet, the deflecting cam and the raising cam being fixed with respect to the cam means.

3. A knitting machine as claimed in claim 1, wherein the cam means comprises a pushing cam, a tuck raising cam, a clearing raising cam, and a sinker cam, and wherein the slider is provided with a first butt for cooperation with the pushing cam and with a further butt for cooperation with the tuck raising cam, the clearing raising cam, and the sinker cam.

4. A knitting machine as claimed in claim 1, wherein the needle bed is a needle cylinder.

5. A knitting machine as claimed in claim 4, wherein the cylinder rotates about a vertical axis, the support and the cam system are disposed outwardly of the cylinder, and in which the knitting needles, sliders, and selectors are suscessively disposed beginning adjacent the top of the cylinder.

* * * * *